US005295469A

United States Patent [19]

Kariya et al.

[11] Patent Number: 5,295,469

[45] Date of Patent: Mar. 22, 1994

[54] SAFETY VALVE FOR FUEL INJECTION APPARATUS

[75] Inventors: Yasuhiro Kariya, Hino; Kenji Funai, Kariya, both of Japan

[73] Assignee: Nippondenso Co., Ltd., Kariya, Japan

[21] Appl. No.: 935,109

[22] Filed: Aug. 27, 1992

Related U.S. Application Data

[63] Continuation-in-part of Ser. No. 724,339, Jul. 5, 1991, abandoned.

[30] Foreign Application Priority Data

Jul. 9, 1990 [JP] Japan ..... 2-182410

[51] Int. Cl.[5] ..... F02M 41/00

[52] U.S. Cl. ..... 123/456; 123/467

[58] Field of Search ..... 123/447, 506, 457, 456, 123/198 D, 467

[56] References Cited

U.S. PATENT DOCUMENTS

| | | |
|---|---|---|
| 3,373,764 | 3/1968 | Munn . |
| 3,742,926 | 7/1973 | Kemp . |
| 4,062,336 | 12/1977 | Gant et al. . |
| 4,073,275 | 2/1978 | Hofer et al. . |
| 4,217,862 | 8/1980 | Fort et al. . |
| 4,273,090 | 6/1981 | Hofer et al. . |
| 4,389,987 | 6/1983 | Frankle et al. . |
| 4,509,491 | 4/1985 | Kawatei . |
| 4,513,719 | 4/1985 | Edo . |
| 4,554,903 | 11/1985 | Straubel et al. . |
| 4,577,606 | 3/1986 | Bohringer et al. . |
| 4,633,836 | 1/1987 | Faupel . |
| 4,651,779 | 3/1987 | Filippi et al. . |

FOREIGN PATENT DOCUMENTS

| | | |
|---|---|---|
| 0145436 | 6/1985 | European Pat. Off. . |
| 0299337 | 1/1989 | European Pat. Off. . |
| 2341087 | 9/1977 | France . |
| 2609503 | 7/1988 | France . |
| 2-163458 | 6/1990 | Japan . |
| 925590 | 5/1963 | United Kingdom . |

*Primary Examiner*—Carl S. Miller

*Attorney, Agent, or Firm*—Cushman, Darby & Cushman

[57] ABSTRACT

A safety valve provided in a fuel injection apparatus includes an accumulator in which fuel is accumulated. The housing has an inside passage for introducing high-pressure fuel of the accumulator into the inside of the housing and a seat face formed at a portion of the inside passage. A valve element provided movably within the housing includes a valve body to open/close the seat face and an elastic member for pressing and biasing the valve element in a closing direction. A fuel chamber defined between the inner surface of the housing and the valve element maintains pressure for pressing the valve element in a valve-opening direction, and high pressure fuel from the inside passage is introduced into the fuel chamber when the valve body of the valve element is separated from the seat face. With this safety valve, the high-pressure fuel of the accumulator is introduced into the fuel chamber in order to press the valve element in the valve-opening direction so that the valve element will be rapidly opened, with the result that the fuel pressure in the accumulator can recover a predetermined value instantaneously.

14 Claims, 7 Drawing Sheets

SAFETY VALVE FOR FUEL INJECTION APPARATUS

This application is a continuation-in-part of copending application No. 07/724,339, filed Jul. 5, 1991, now abandoned.

BACKGROUND OF THE INVENTION

1. Field of the Invention

The present invention relates to a safety valve of an accumulator in a fuel injection apparatus of a diesel engine for injecting high-pressure fuel accumulated in the accumulator by means of an injector of an electronic control type provided in each cylinder.

2. Description of the Prior Art

There has been conventionally known a fuel injection apparatus, as disclosed in Japanese Patent Unexamined Publication No. 59-165858, which is arranged in such a manner that high-pressure fuel is accumulated in an accumulator called a common rail by a high pressure supply pump, and the high-pressure fuel of the accumulator is injected by an injector of an electronic control type provided in each cylinder.

This fuel injection apparatus is provided with a safety valve which is opened for releasing the fuel when a pressure in the accumulator exceeds a predetermined value.

As shown in FIG. 5, the structure of the conventional safety valve is such that a tapered seat face 32 which is an opening portion of a passage 31 in communication with the accumulator is opened/closed by a ball valve 37, and that when the fuel pressure in the accumulator exceeds a biasing force of a spring 38 which presses and biases the ball valve 37 in a valve-closing direction, the ball valve 37 is opened to release the fuel of the accumulator to the low pressure side, thereby suppressing an increase of pressure in the accumulator.

With this structure, however, an area of an opening after the ball valve 37 is opened is insufficient. Consequently, even after the fuel has been once released through the opened valve, there is a risk that the pressure in the accumulator is increased to exceed a valve-opening pressure of the ball valve 37 when the fuel is pressurized and delivered again. Particularly when the fuel of a maximum flow rate $Q_{max}$ is pressurized and delivered from the high-pressure supply pump to the accumulator, there is a risk, as shown in FIG. 6, that the fuel pressure is increased to exceed not only the valve-opening pressure $P_0$ but also a critical internal pressure $P_E$ of an accumulation piping.

SUMMARY OF THE INVENTION

It is an object of the present invention to provide a fuel injection apparatus capable of preventing abnormal increase in fuel pressure.

Therefore, the present invention is intended to provide a safety valve of a fuel injection apparatus which can obtain a property of a large flow rate after the valve is opened and which can constantly maintain the pressure in an accumulator to be not higher than a critical pressure.

It is a further object of the invention to provide a safety valve which enables the fail-safe system to function favorably at the time of trouble by regulating a clearance between the inner peripheral surface of a small-diameter section and the outer peripheral surface of a valve element so as to set the increased fuel pressure in the accumulator to a predetermined value.

Another object of the invention is to provide a safety valve which enables the fuel pressure in the accumulator to recover a predetermined value instantaneously by opening the valve rapidly once it reaches a valve-opening pressure.

BRIEF DESCRIPTION OF THE DRAWINGS

FIG. 1 is a cross-sectional view showing the whole structure of the safety valve;

FIG. 2 is a schematic view showing the entire system of a fuel injection apparatus including the safety valve applied to the present embodiment;

FIG. 3 is an enlarged fragmentary view of a portion enclosed by a circle line III in FIG. 1; and FIG. 4 is an operational characteristic graph of the safety valve.

FIG. 5 is a cross-sectional view showing the whole structure of the conventional safety valve; and FIG. 6 is an operational characteristic graph of the safety valve.

FIG. 7 is a cross-sectional view of the safety valve in a closed condition;

FIG. 8 is an enlarged perspective view of an encircled portion of a central portion in FIG. 7;

FIG. 9 is a perspective view of a valve body 230;

FIG. 10 is an enlarged perspective view of a portion of the valve body 230; and FIG. 11 shows an opened condition of the safety valve.

FIG. 13 is a cross-sectional view of the safety valve and shows a state of the opened safety valve;

FIG. 14 a plane view of the valve body;

FIG. 15 is a cross-sectional view taken along line 15—15 of FIG. 14; and FIG. 16 is a cross-sectional view, in which the central portion is enlarged, of the safety valve in an opened state.

DETAILED DESCRIPTION OF THE PREFERRED EMBODIMENT

One embodiment of the present invention will be hereinafter described with reference to the attached drawings.

Figure 2:
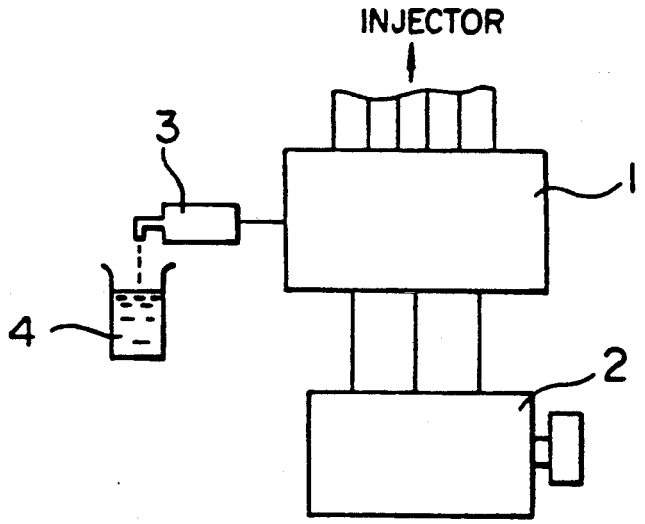

In FIG. 2, fuel supplied from a fuel tank (not shown) is pressurized and delivered through a conduit via a delivery valve by means of a high-pressure supply pump 2 such as a priming pump, and accumulated in an accumulation chamber of an accumulator 1 which is called a common rail.

The high-pressure fuel accumulated in the accumulation chamber of the accumulator 1 is injected into an internal combustion engine through an opened nozzle hole when a nozzle needle having a distal-end portion to open/close the nozzle hole is biased in a valve-opening direction by the pressure of fuel supplied through a check valve and a passage in an injector of an electronic control type (not shown) provided in each cylinder.

At an end portion of the accumulator 1, there is provided a safety valve 3 for controlling the fuel pressure in the accumulator 1 so as to prevent it from exceeding a critical value.

Figure 1:
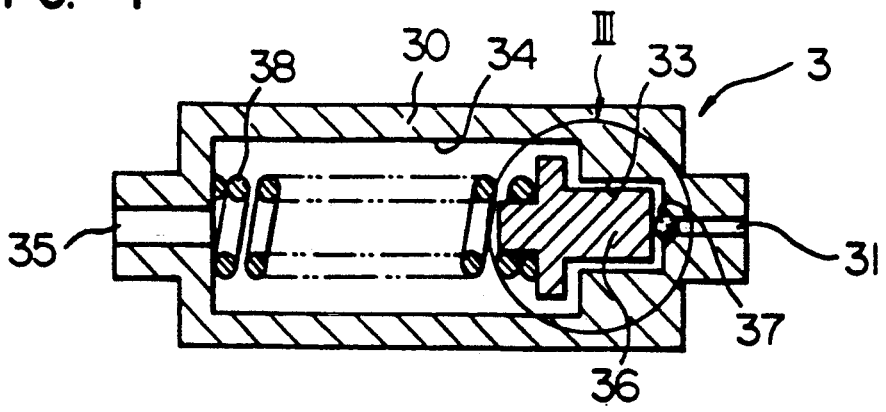
FIGS. 1 to 4 relate to one embodiment of a safety valve according to the present invention.
Figure 3:
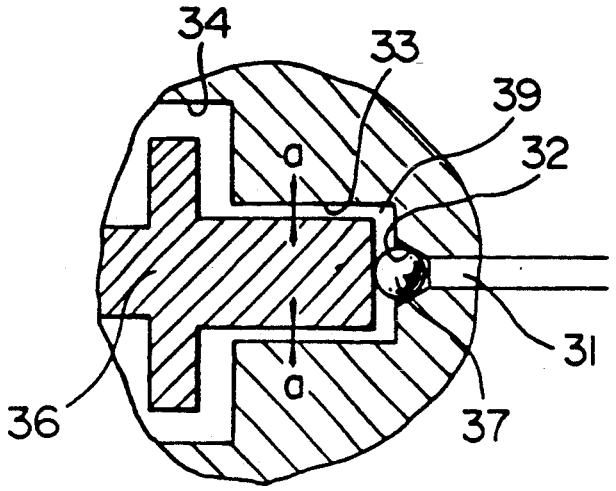

As shown in FIGS. 1 and 3, the safety valve 3 comprises: a housing 30 which includes an inside passage 31 in communication with the accumulator 1, a tapered seat face 32 formed at an opening portion of the inside passage 31, a small-diameter section 33, a spring chamber 34 and a low-pressure passage 35 in communication with a fuel tank 4 on the low pressure side of the safety valve; a valve element 36 provided movably within the housing 30, with a ball valve 37 to open/close the seat face 32 being fixed on this valve element; and a spring 38 which presses and biases the valve element 36 in a valve-closing direction. The valve element 36 is closely fitted in the small-diameter section 33 of the housing 30, and a fuel chamber 39 which maintains a pressure for pressing the valve element 36 in the valve opening direction is defined between the valve element 36 and the end surface of the small-diameter section 33.

The safety valve of the above-described structure is operated in the following manner.

When the fuel pressure in the accumulator 1 is not higher than a valve-opening pressure of the ball valve 37 which is predetermined by the spring 38, the ball valve 37 is contacted with the seat face 32.

With the ball valve 37 in this state, when the fuel pressure in the accumulator 1 is increased, the fuel introduced from the inside passage 31 causes the ball valve 37 to be opened against a biasing force of spring 38. Consequently, the fuel introduced from the inside passage 31 flows into the fuel chamber 39 and presses the valve element 36 in the valve-opening direction. As a result, the valve element 36 is rapidly opened to allow the fuel introduced from the inside passage 31 to flow to the low pressure side of the safety valve at once so that the accumulator 1 will recover a predetermined pressure in an instant.

Figure 4:
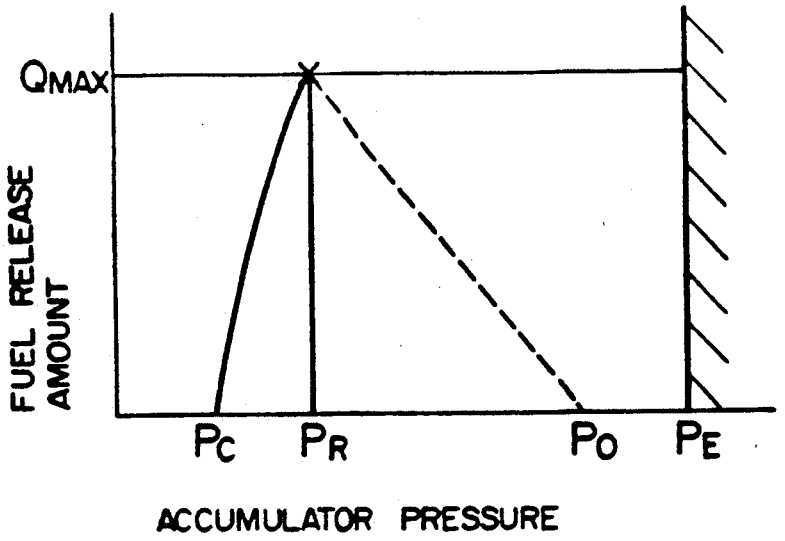
Figure 5:
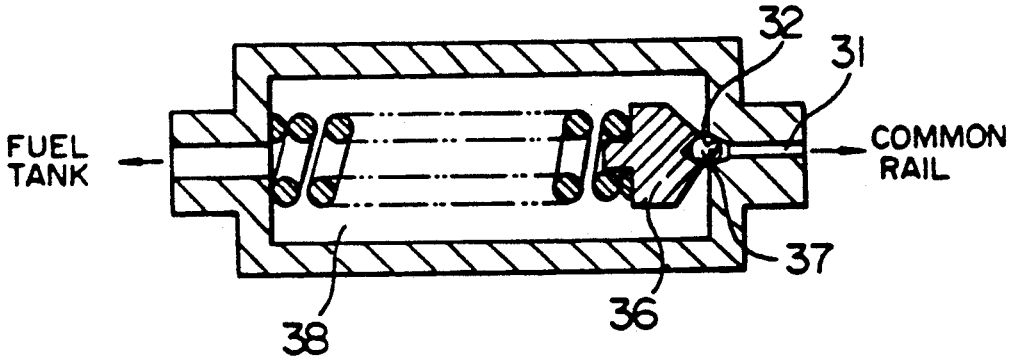
FIGS. 5 and 6 relate to prior art concerning the present invention.
Figure 6:
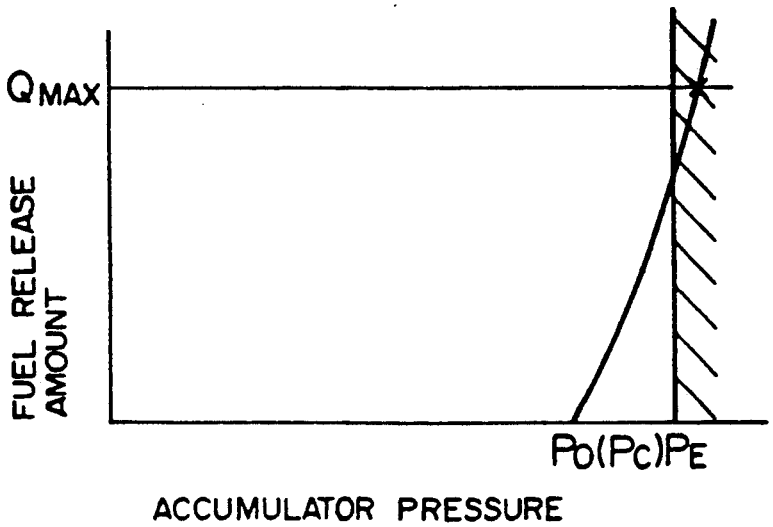

FIG. 4 illustrates a change of the fuel pressure in the accumulator i from the opening to the closing of the safety valve. When the ball valve 37 is opened at a valve-opening pressure $P_0$, the fuel pressure is decreased to a pressure $P_R$ instantaneously, and eventually reaches a valve-closing pressure $P_C$ of the ball valve 37.

The pressure $P_R$ can be set to a predetermined value by regulating the clearance a between the valve element 36 and the small-diameter section 33, and when the pressure $P_R$ is set to a minimum value which the pressure in the accumulator 1 is required to have for operating the engine, the fail-safe and limp-home system can function favorably if trouble occurs.

Figure 7:
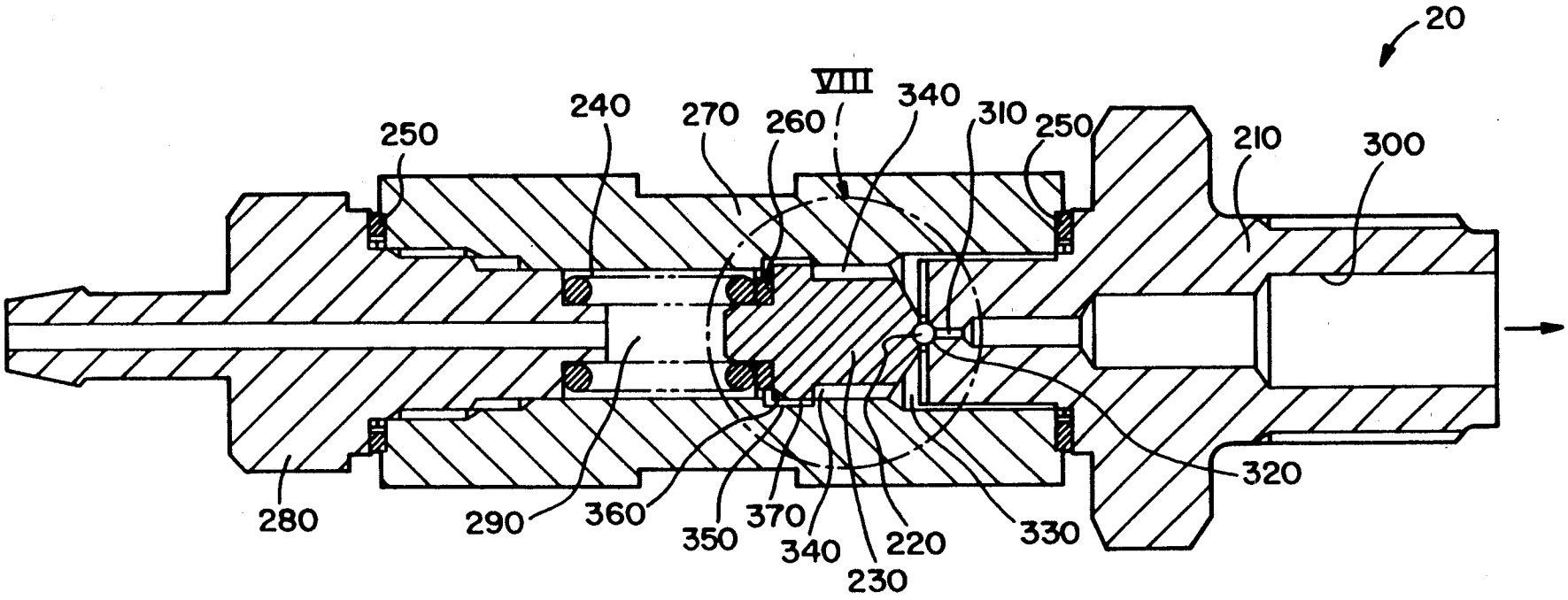
FIGS. 7–11 show embodiments of the safety valve according to the present invention.
Figure 8:
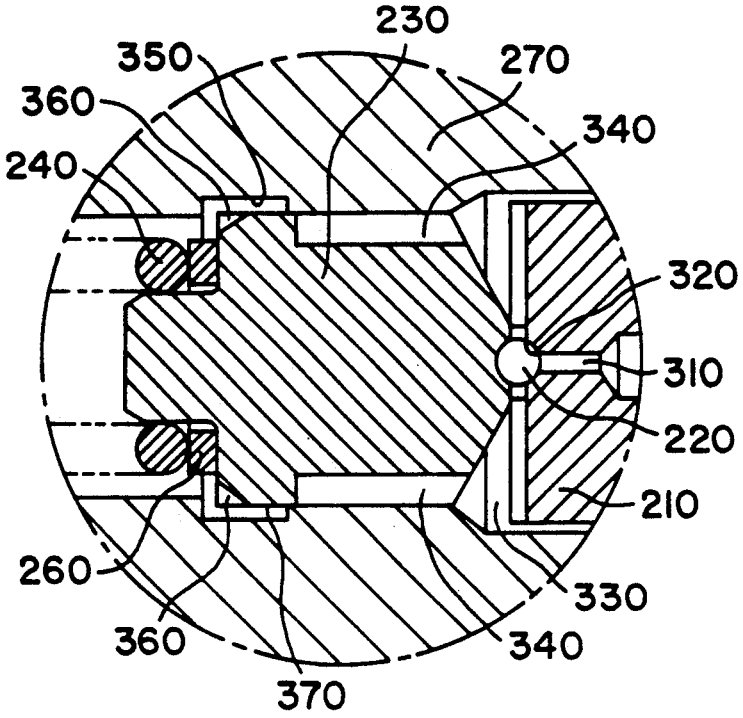

The safety valve 20 in FIGS. 7 and 8 is connected to a pressure accumulating piping or accumulator 1 shown in FIG. 2. A connecting pipe 210 connected to the pressure accumulating piping 1 has an inner passage 300 formed therein. A throttle passage 310 is formed in an end portion of this inner passage 300. A tapered seat surface 320 formed in an opened end of this throttle passage 310. The connecting pipe 210 is threaded in a cylindrical housing 270 from one end of this housing 270, so that a gasket 250 is mounted between the connecting pipe 210 and the housing 270.

In the housing 270, a valve body 230 is contained movable in an axial direction thereof and holds a ball valve 220. Further, a pipe 280 is threaded into an another end of the housing 270, and a gasket 250 is mounted between the housing 270 and pipe 280. A spring 240 is contained in a spring chamber 290 within the housing 270. The spring 240 is mounted between the valve body 230 and the pipe 280 to bias the valve body 230 in the direction of the connecting pipe 210. This makes the ball valve 220 abut to the seat surface 320. A shim 260 is mounted between the valve body 230 and the spring 240, so that a force biased to the valve body 230 is changed thereby to change a pressure for opening the valve. A fuel retaining chamber 330 is formed between the connecting pipe 210 and the valve body 230.

Figure 9:
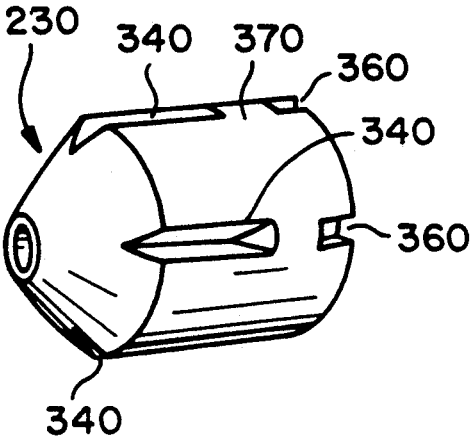
Figure 10:
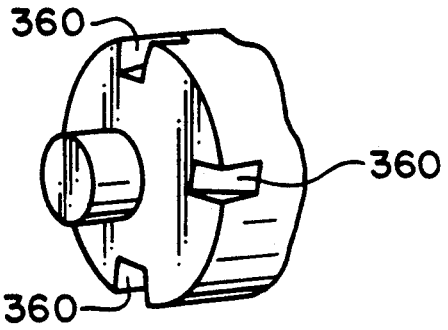

The valve body 230 has a cylindrical, peripheral surface and is contained with a very small clearance in a cylindrical space within the housing 270. Further, an end surface of the valve body 230 facing the connecting pipe is formed in a conical form, and a projection for supporting the spring 244 is formed on an end surface of a spring chamber side. Four longitudinal grooves 340 are formed on an outer peripheral surface of the valve body 230 at an end adjacent connecting pipe 210 so as to extend longitudinally from an end surface of the valve body 230 to a predetermined position as shown in FIG. 9. These four longitudinal grooves 340 are circumferentially spaced 90° apart. Further, in a corner portion of the valve body 230 at an end adjacent spring chamber 290, four passage grooves 360 are formed as shown in FIG. 10 to extend from an end surface thereof adjacent spring chamber 290 to a predetermined position along the outer peripheral surface of valve body 230. These communicating grooves 360 are spaced 90° apart. A seal surface having no longitudinal groove 340 and no communicating groove 360 is formed over the entire peripheral surface of the valve body 230.

In an inner side of the housing 270, an annular groove 350 is formed so as to correspond to an outer periphery of an end surface of the valve body 230 adjacent the spring chamber 290. Furthermore, the cylindrical space in housing 270 for a spring chamber 290 has a diameter smaller than the cylindrical space for containing the valve body 230, so that the valve body 230 abuts a step difference formed in an interface of the spring chamber 290 and the valve body containing portion when the valve is opened as hereinafter described.

In this case, the longitudinal grooves 340 formed in the valve body 230 are formed so as to communicate with the annular groove 350 when the valve body 230 moves more than a predetermined distance from its closed position shown in FIG. 7. While moving the valve body 230 until the longitudinal groove 340 communicates with the annular groove 350, fuel is prevented from flowing by sealing provided by the seal surface 370 on the outer periphery of the valve body 230 and an inner peripheral surface of the housing 270.

Following the above description of the structure, operation of the safety valve is as follows.

When the fuel pressure of the pressure accumulating piping 1 is lower than the pressure defined by the spring 240 for opening the ball valve 220, the valve body 230 is in a state shown in FIG. 7 and the ball valve 220 seats on the seat surface 320, so that discharging of the fuel from the pressure accumulating piping 1 is prevented.

Figure 11:
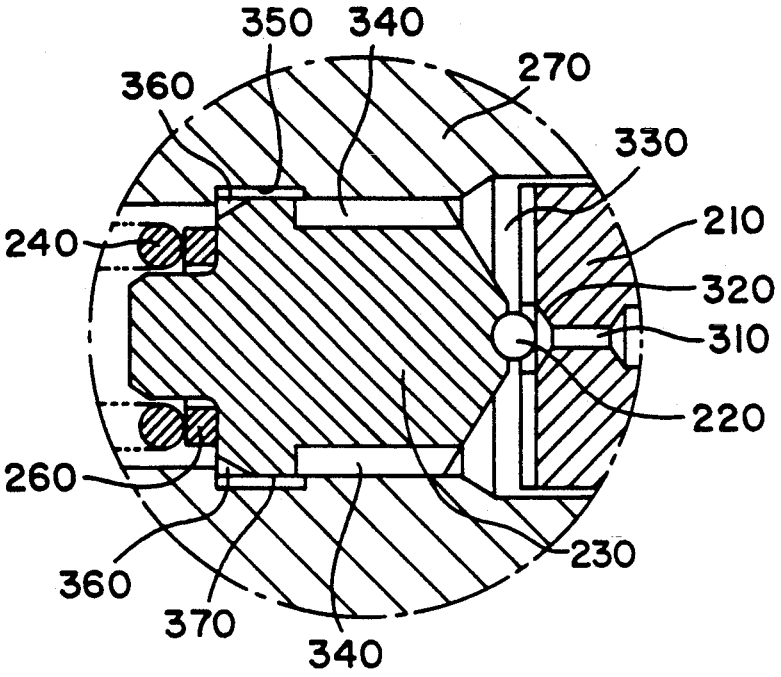

When the fuel pressure of the pressure accumulating piping 1 is increased to increase the fuel pressure introduced into an inner passage 300, the fuel pressure applied to the ball valve 220 is increased to urge the ball valve 220 and the valve body 230 against the bias force of spring 240 in the left direction in FIG. 7. When the ball valve 220 departs from the seat surface 320 thereof, the high-pressure fuel is introduced into a fuel accumulating chamber 330 through the throttle passage 310. The high-pressure fuel introduced into fuel accumulating chamber 330 is applied to the valve body 230 and suddenly moves the valve body 230 against spring 240 in the leftward direction in FIG. 7. When the valve body 230 is moved more than a predetermined length and the longitudinal grooves 340 formed in the valve body 230 communicate with an annular groove 350, the fuel entirely flows out into the spring chamber 290 through the longitudinal grooves 340, annular groove 350 and communicating grooves 360. Therefore, the fuel of the pressure accumulating piping 1 is discharged by in turn flowing out through the inner passage 300, the throttle passage 310, the fuel accumulating chamber 330, the longitudinal grooves 340, the annular groove 350, the communicating grooves 360, the spring chamber 290 and the pipe 280. This instantaneously suppresses the fuel pressure within the pressure accumulating piping 1 and prevents excessively increasing the fuel pressure. The open state of the ball valve 220 is shown in FIG. 11.

When the fuel pressure in the pressure accumulating piping 1 is decreased by discharging of the fuel and reaches a valve-closing pressure at a predetermined pressure lower than the valve-opening pressure of the ball valve 220, the valve body 230 is moved in the rightward direction in FIG. 7 by the bias force of spring 240. This suddenly decreases flowing-out of the fuel by cutting off communication between the longitudinal grooves 340 and the annular groove 350. Further, the valve body 230 is moved in the rightward direction on the drawing, so that the ball valve 220 is seated on the seat surface 320 to stop fuel flow.

Furthermore, when the fuel pressure in the pressure accumulating piping 1 causes small vibrations or hunting in the neighborhood of the valve-opening pressure of the ball valve 220. When such fine vibration is generated, the ball valve 220 may be temporarily opened. However, even if the valve body 230 is moved a very small distance by contemporarily opening the ball valve 220, the longitudinal grooves 340 do not communicate with the annular groove 350. Further, part of the seal surface 370 remains in contact with the inner surface of the housing 270 over a predetermined length thereof. Therefore, the fuel is not discharged by the fine movement of the valve body 230. Thus, it is prevented that fuel is discharged therefrom by fine pulsations of the fuel pressure.

As mentioned above, in such an embodiment, the pressure for opening the valve is higher than that for closing the valve. Therefore, even if the fuel is discharged therefrom by increasing the fuel pressure in the pressure accumulating piping I so as to be increased more than the valve-opening pressure, the fuel pressure in the pressure accumulating piping 1 after discharging of the fuel can be maintained at a predetermined pressure more than the valve-closing pressure. Thus, even if there occurs such a situation that the fuel pressure in the pressure accumulating piping 1 is excessively increased, the fuel pressure in the pressure accumulating piping 1 can be instantaneously decreased at a safety pressure lower than the valve-opening pressure of the ball valve. Further, the fuel pressure in the pressure accumulating piping 1 after decreasing of the fuel pressure is maintained at a pressure lower than the valve opening pressure of the ball valve and higher than the valve closing pressure of the ball valve, so that the continuity of fuel injection is made possible so as to be able to operate an engine continuously.

Further, in this embodiment, a predetermined stroke of the valve body 230 (leftward in FIG. 11) is necessary between the time of opening of the first stage valve (provided by the ball valve 220 and the seat surface 320) and the opening of the second stage valve (provided by the longitudinal groove 340 and the annular groove 350). Therefore, in order to open the second stage valve, it is necessary for an amount of the fuel corresponding to this predetermined stroke to flow through a space between the ball valve 220 and the seat surface 320. Accordingly, a predetermined time delay can be caused from the time of opening of the first stage valve to opening of the second stage valve. Hence, even if the first stage valve sensitively reacts and opens due to fine pulsations of the fuel pressure, a very large out flow of fuel is prevented by the second stage valve. Further, it is made possible to adjust the fuel pressure in the pressure accumulating piping 1 so as to reach high pressure near to the valve-opening pressure of the ball valve 220.

Figure 12:
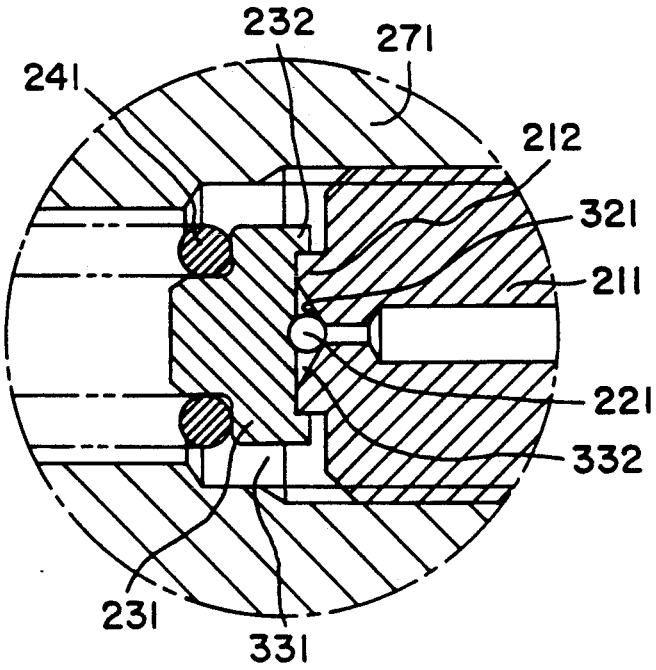
FIG. 12 shows another embodiment of the safety valve.
Figure 13:
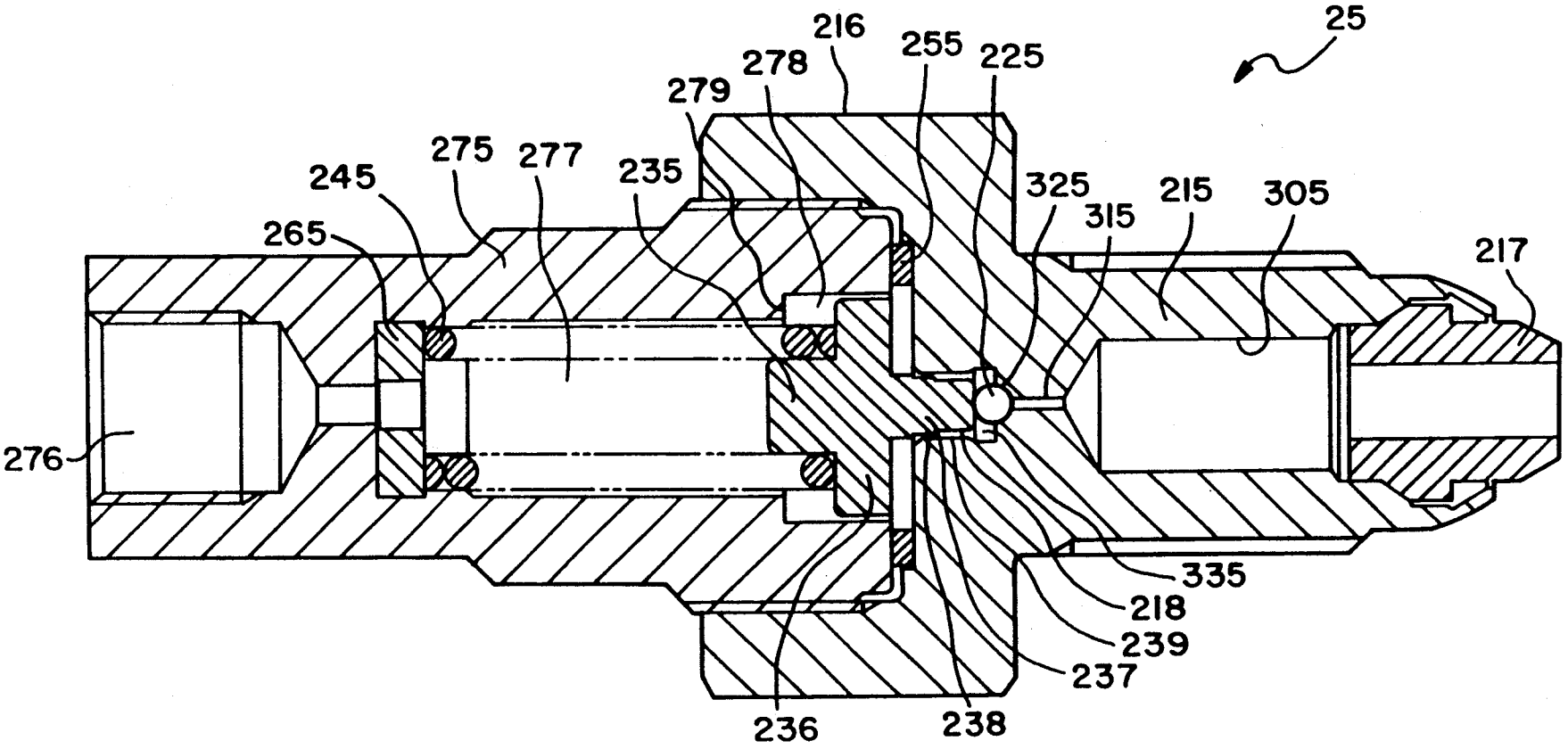
FIGS. 13–16 show a further embodiment of the safety valve according to the present invention. In this embodiment, the stroke of the valve body and the area of the groove is made larger than those of the embodiments of FIGS. 7 and 12.

FIG. 12 shows another embodiment of a safety valve according to the present invention. In FIG. 12, only a main portion of the safety valve is shown. In this embodiment, a valve body 231 is provided in a fuel retaining chamber 331 formed by the connecting pipe 211 and the housing 271, in which a ball valve 221 is supported on the valve body 231. The connecting pipe 211 has a cylindrical end projection portion 212 in an end surface of which is formed a seat surface 321. The valve body 231 has a cylindrical recessed portion 232 formed for receiving the projection portion 212. The projection portion 212 of the connecting pipe 211 is inserted into the cylindrical portion 232 of the valve body 231 with a very small clearance, and the fuel retaining chamber 332 is formed between the projection portion 212 and the cylindrical portion 232.

In the embodiment of FIG. 12, a first stage valve consists of the ball valve 221 and the seat surface 321, and the second stage valve consists of the projection portion 211 and the cylindrical portion 232. When the fuel pressure in the pressure accumulating piping 1 increases, the ball valve 221 departs from the seat surface 321, so that the high-pressurized fuel is introduced into the fuel retaining chamber 332. This high-pressurized fuel presses the valve body 231 against the spring 241 so as to move the ball valve 231 for more than a predetermined stroke, thereby allowing the cylindrical portion 232 to depart from the projection portion 212 to discharge the fuel therefrom. Further, since a large amount of fuel is not discharged until the valve body 231 is moved more than the predetermined stroke thereof, unnecessary discharging of the fuel is prevented when the ball valve 22 is opened temporarily.

In the embodiment of FIGS. 13–16, safety valve 25 has a connecting pipe 215 connected to the pressure accumulating piping 1, and a cylindrical housing 275 threaded in a large diametral portion 216. Further, a gasket 255 is mounted between the connecting pipe 215 and the housing 275.

In an opening portion of the connecting pipe 215 at the side of the pressure accumulating piping 1, the pipe 217 is fixed thereto by caulking. On an end surface of the connecting surface 215 at the side of the housing 275, a cylindrical valve containing space 218 is formed therein. On a bottom surface of the valve containing space 218, the seat surface 325 is formed thereon to communicate with the pressure accumulating piping 1 through the throttle passage 315, the inner passage 305 and the pipe 217.

In the housing 275, a connecting portion 276 is formed therein. The connecting portion 276 is connected to a return piping for returning the fuel discharged through the safety valve 25 to a fuel tank once more. In the housing 275, a spring chamber 277 for containing a spring and a valve body chamber 278 for containing a valve body are also formed therein, in which an abutting surface 279 for restricting movement of the valve body is formed between the spring chamber 277 and the valve body chamber 278.

Figure 14:
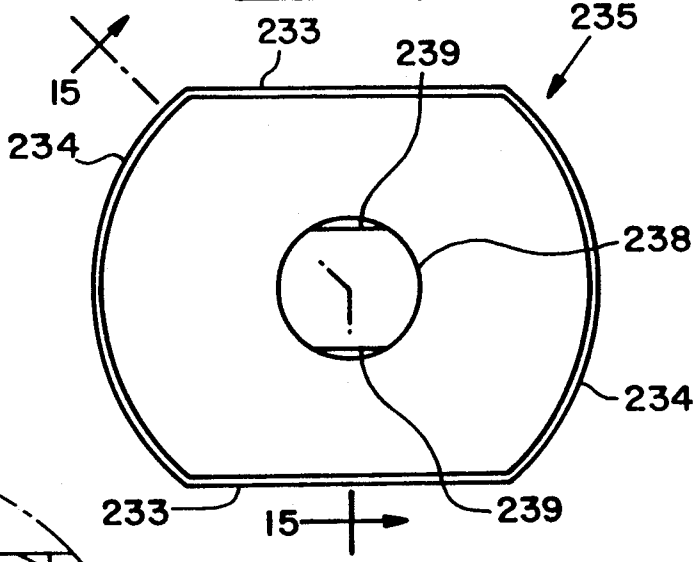
Figure 15:
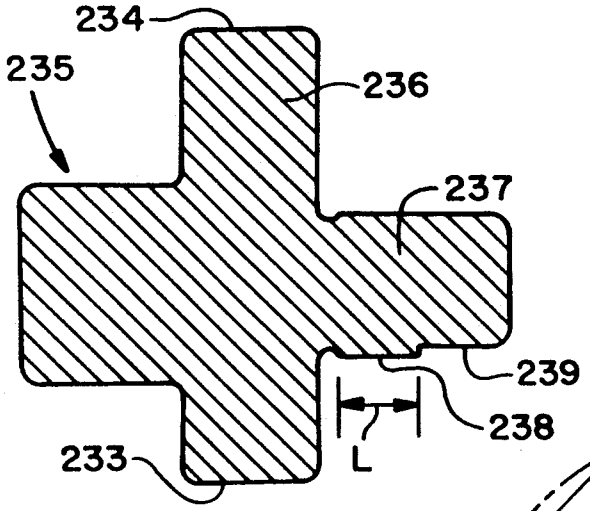
Figure 16:
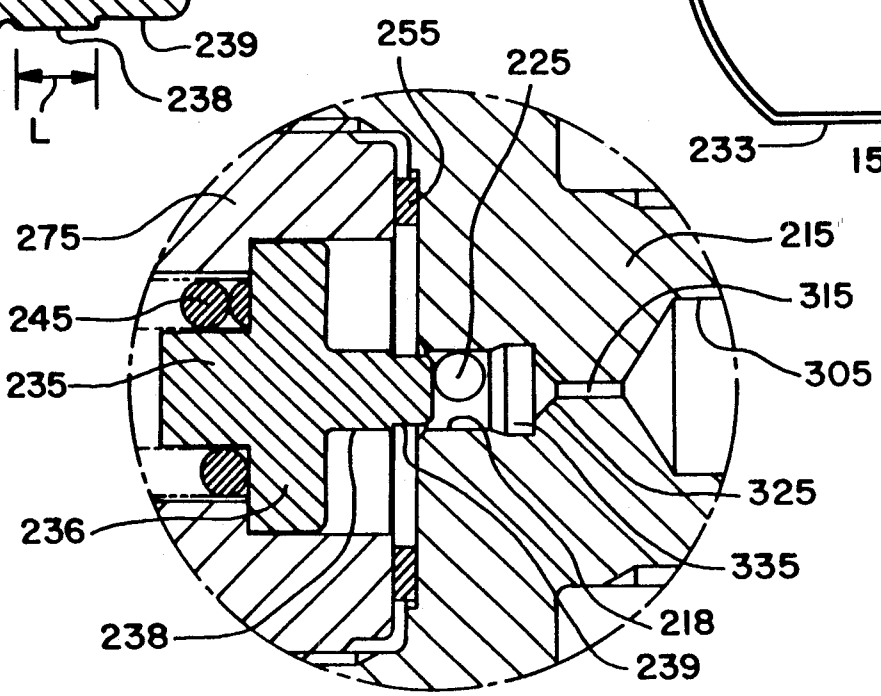

The valve body 235 has a large diametral portion 236 contained in the valve body chamber 278 of the housing 275 and a small diametral portion 237 inserted into the valve containing space 218 of the connecting pipe 215. As shown in FIGS. 14 and 15, the large diametral portion 236 has a cylindrical surface 234 and a passage surface 233, in which a fuel passage is formed between the passage surface 233 and the valve body chamber 278. In the small diametral portion 237, a cylindrical surface 234 and a passage surface 239 are also formed therein. This passage surface 239 is formed a two plane portions at both sides of the cylindrical small diametral portion 237 so as to extend from a tip end surface of the small diametral portion 237 to a half length thereof. The remaining surface thereof is formed as a cylindrical surface 238. A portion of the cylindrical surface 238 is inserted into the valve containing space 218 with a fine clearance with respect to an inner surface thereof. Therefore, in the cylindrical surface 238 of this embodiment, a range of the cylindrical surface as shown with a length L in FIG. 15 functions as a seal surface.

The valve containing space 218 of the connecting pipe 215 contains the ball valve 225. The ball valve 225 abuts the seat surface 325 so as to shut off a fuel passage connected to the throttle passage 315. In this case, since a movement stroke of the valve body 235 is restricted by the abutting surface 279, the small diametral portion 237 does not entirely go out of the valve body containing space 218. Therefore, the ball valve 225 is surely held in the valve body containing space 218.

The spring chamber 277 of the housing 275 contains a shim 265 and a spring 245 for biasing the valve body 235.

Now, the operation of this FIG. 13-16 embodiment is described as follows.

When the fuel pressure in the pressure accumulating piping 1 is excessively increased over the valve opening pressure of the ball valve, the ball valve 225 departs from the seat surface 325 against the bias force of the spring 245, so that the fuel flows into the fuel retaining chamber 335. That fuel presses the valve body 235 against the bias force of the spring 245. In this case, the valve body 235 is pressed by a stronger force after opening of the ball valve 225 than that force which operated when the ball valve 225 opened. The valve body 235 then moves to expose the passage surface 239 to the valve body chamber 278 from the valve body containing space 218, so that a large amount of fuel suddenly flows thereto. The fuel is discharged in turn through the passage surface 233, the spring chamber 277, and the connecting pipe 276. In this case, the flowing rate of the fuel can be adjusted by the throttle passage 315. In the meantime, the fuel pressure in the pressure accumulating piping 1 decreases to a predetermined pressure lower than the valve opening pressure of the ball valve so as to move the valve body 235 toward a rightward in the drawing, thereby pressing the ball valve 225 to the seat surface 325 so as to stop the discharging the fuel. Accordingly, this prevents the fuel pressure in the pressure accumulating piping 1 from excessively increasing.

Further, according to this embodiment, as shown in FIG. 15 an axial length L of the cylindrical surface formed between the passage surface 239 and the large diametral portion 236 is extended over a required length thereof. Therefore, even if the fuel pressure in the pressure accumulating piping i causes fine pulsations to open the ball valve 225 temporarily, a large amount of fuel is not discharged therefrom until the valve body 235 moves the length of this axial length L. This prevents the fuel from being discharged by the safety valve which sensitively reacts to the fine pulsations of the fuel pressure in the pressure accumulating piping 1.

Further, according to this FIG. 13-16 embodiment, the safety valve can be assembled by merely combining the housing 275 with the connecting pipe 215. In addition to this, since the shim 265 and the spring 245 are incorporated in the housing 275 at one side thereof, the connecting portion 276 can be formed in an opposite side of the housing 275. This arrangement can suppress a number of parts included in the valve and others.

According to the present invention, as described heretofore, when the valve body of the valve element is separated from the seat face, the high pressure fuel introduced from the inside passage flows into the fuel chamber, and the pressure in this fuel chamber presses the valve element in the valve-opening direction so that the valve element will be rapidly opened, with the result that the fuel pressure in the accumulator can recover a predetermined value instantaneously.

We claim:

1. A safety valve for a fuel injection apparatus, said safety valve being provided in an accumulator in which pressurized fuel is accumulated and the pressurized fuel in said accumulator flows to a low-pressure side thereof, said safety valve comprising:

first valve means opened and closed by receiving the pressurized fuel pressure in said accumulator and for flowing out the fuel in said accumulator by opening said valve means when the fuel pressure in said accumulator reaches a pressure more than a predetermined pressure of the fuel in said accumulator, and second valve means having a valve body moved from a first position by pressure of the fuel from said first valve means, said second valve means discharging the fuel from said first valve means to said low-pressure side by opening said second valve means when said valve body has moved a distance from said first position more than a predetermined stroke thereof.

2. A safety valve for a fuel injection apparatus according to claim 1, wherein said first valve means is opened when the fuel pressure of said accumulator becomes more than a first pressure and closed when the fuel pressure of said accumulator becomes a second pressure lower than said first pressure.

3. A safety valve for a fuel injection apparatus according to claim 1, wherein said first valve means comprises:

a housing having a fuel passage into which the fuel of said accumulator is introduced and a seat surface formed in said fuel passage, and a ball valve disposed in said housing and for closing said fuel passage by contacting with said seat surface and opening said fuel passage by moving away from said seat surface.

4. A safety valve for a fuel injection apparatus according to claim 1, wherein said second valve means comprises:

a housing having a fuel chamber for introducing the fuel flown out from said first valve means and a valve-body containing chamber facing said fuel chamber and for containing said valve body movable therein, and wherein a passage for communicating said fuel chamber with said low-pressure side when said valve body is moved more than said predetermined stroke thereof and a seal portion for restricting flowing of the fuel between said valve body and said housing during moving of said valve body in said predetermined stroke thereof are formed between said valve body and said housing.

5. A safety valve for a fuel injection apparatus according to claim 4, wherein said passage includes a groove formed in said valve body.

6. A safety valve for a fuel injection apparatus according to claim 4, wherein said valve body is formed in a cylindrical shape, and said passage has two plane surfaces formed in said cylindrical valve body.

7. A safety valve for a fuel injection apparatus, said safety valve being provided in an accumulator in which pressurized fuel is accumulated and flowing out the pressurized fuel of said accumulator to a low-pressure side thereof, said safety valve comprising:

a housing having a fuel passage for introducing the fuel of said accumulator thereinto and a seat surface formed in said fuel passage, a movable valve member contained movably in said housing and for closing said fuel passage by abutting with said seat surface in a first position thereof and for closing said fuel passage by receiving the fuel pressure of said accumulator to move from said first position thereof so as to depart from said seat surface, a biasing means for biasing said movable valve member toward said first position thereof, a fuel chamber formed between said movable valve member and said housing and for flowing the fuel from said accumulator thereinto when said fuel passage is opened, a passage formed between said movable valve member and said housing and for communicating said fuel chamber with said lower side thereof when the fuel is flown into said fuel chamber and said movable valve member is moved at a distance more than a predetermined stroke thereof from said predetermined position, and a seal portion formed between said movable valve member and said housing and for restricting flowing out of the fuel from said fuel chamber to said lower side thereof during moving of said movable valve member at said predetermined stroke thereof.

8. A safety valve for a fuel injection apparatus according to claim 7, wherein said movable valve member comprises:

a ball valve abutting on said seat surface, a valve body movably contained in said housing and pressing said ball valve toward said seat surface, and said seal portion and said passage being formed between said valve body and said housing.

9. A safety valve for a fuel injection apparatus according to claim 8, wherein when said ball valve abuts on said seat surface, an area of said ball valve for receiving the fuel pressure is smaller than that for receiving the fuel pressure when said ball valve is spaced from said seat surface, and the fuel pressure for closing said ball valve is lower than that for opening said ball valve.

10. A safety valve for a fuel injection apparatus according to claim 8, wherein said valve body is formed in a cylindrical form, said housing has a valve body chamber inserted by said cylindrical valve body through a very small clearance and a low-pressure chamber having an inner diameter larger than that of said cylindrical valve body and communicating with said low-pressure side, said passage has a groove formed over a predetermined length in an axial direction from a distal-end surface of said cylindrical valve body, said seal surface has a cylindrical surface remained at said low-pressure chamber near to said groove, and said groove communicates said fuel chamber with said low-pressure side through an opening formed in said low-pressure chamber.

11. A safety valve for a fuel injection apparatus according to claim 8, wherein said valve body is formed in a cylindrical form, said housing has a valve body chamber into which said cylindrical valve body is inserted through a very small clearance and a low-pressure chamber having an inner diameter larger than that of said valve body chamber and communicated with said lower said thereof, said passage has two parallel plane portions formed over a predetermined length from a distal-end of said cylindrical valve body in an axial direction thereof, said seal surface has a cylindrical surface remained in said low-pressure chamber rather than said groove formed in said cylindrical valve body, and said plane portions communicates said low-pressure side with said fuel chamber through an opening formed in said low-pressure chamber.

12. A safety valve for a fuel injection apparatus according to claim 7, wherein said housing comprises:

a first housing member having said seat surface provided at a side of said accumulator, having said fuel passage formed in an internal portion thereof and said seat surface formed in a distal-end of said fuel passage, and a second housing member provided at said low-pressure side thereof and connected to said first housing member, and having a chamber for containing said movable valve member and an annular groove having an inner diameter larger than that of said containing chamber and communicated with said low-pressure side.

13. A safety valve for a fuel injection apparatus according to claim 7, wherein said housing comprises:

a first housing member provided in a side of said accumulator and with said fuel passage in an internal portion thereof, and having said seat surface formed at a distal end of said fuel passage, said first housing member having a projection portion formed so as to be cylindrically projected from an outer periphery of said seat surface and inserted into said movable valve member to form said fuel chamber, and a second housing member provided in said low-pressure side and connected to said first housing member, said second housing member having a chamber for containing said movable valve member, said fuel chamber being formed by said movable valve member and said projection portion inserted into said movable member.

14. A safety valve for a fuel injection apparatus according to claim 7, wherein said housing comprises:

a first housing member provided in a side of said accumulator and with a valve-body containing space for movably containing said movable valve, and having said seat surface formed at a bottom portion of said valve-body containing space, and a second housing member provided in said low-pressure side and connected to said first housing member, said second housing member having a chamber for containing said movable valve member formed so as to have an inner diameter larger than that of said valve-body containing space formed in said first housing member.

* * * * *